US009970090B2

(12) United States Patent
Parson et al.

(10) Patent No.: US 9,970,090 B2
(45) Date of Patent: May 15, 2018

(54) ALUMINUM ALLOY COMBINING HIGH STRENGTH, ELONGATION AND EXTRUDABILITY

(71) Applicant: Rio Tinto Alcan International Limited, Montreal (CA)

(72) Inventors: Nick C. Parson, Kingston (CA); Raynald Guay, Jonquiere (CA); Alexandre Maltais, Chicoutimi (CA)

(73) Assignee: Rio Tinto Alcan International Limited, Montreal (CA)

( * ) Notice: Subject to any disclaimer, the term of this patent is extended or adjusted under 35 U.S.C. 154(b) by 0 days. days.

(21) Appl. No.: 15/383,354

(22) Filed: Dec. 19, 2016

(65) Prior Publication Data

US 2017/0096731 A1 Apr. 6, 2017

Related U.S. Application Data

(62) Division of application No. 13/905,986, filed on May 30, 2013, now abandoned.

(60) Provisional application No. 61/653,531, filed on May 31, 2012.

(51) Int. Cl.

| | |
|---|---|
| ***C22F 1/05*** | (2006.01) |
| ***C22C 21/04*** | (2006.01) |
| ***C22C 21/08*** | (2006.01) |

(52) U.S. Cl.

CPC ..... *C22F 1/05* (2013.01); *C22C 21/04* (2013.01); *C22C 21/08* (2013.01)

(58) Field of Classification Search

CPC ..... C22F 1/05; C22C 21/08

See application file for complete search history.

(56) References Cited

U.S. PATENT DOCUMENTS

| | | | |
|---|---|---|---|
| 6,364,969 B1 | 4/2002 | Couper | |
| 6,440,359 B1 | 8/2002 | Parson et al. | |
| 6,565,679 B1 | 5/2003 | Jeffrey et al. | |
| 8,147,625 B2 | 4/2012 | Reiso et al. | |
| 2009/0116999 A1* | 5/2009 | Furu | C22C 1/06 420/535 |

FOREIGN PATENT DOCUMENTS

| | | | |
|---|---|---|---|
| AT | 69067 B | | 6/1915 |
| AT | 363550 B | | 8/1981 |
| CA | 1228491 A1 | | 10/1987 |
| DE | 102008048374 B3 | | 4/2010 |
| EP | 0158769 A1 | | 10/1985 |
| EP | 0269773 A1 | | 6/1988 |
| EP | 0912772 A1 | | 5/1999 |
| EP | 1840234 A1 | | 10/2007 |
| EP | 2175042 A1 | | 4/2010 |
| ES | 2026135 T3 | | 4/1992 |
| JP | 56-136960 | | 10/1981 |
| JP | 6136493 | | 7/1984 |
| JP | 2000239810 A | | 9/2000 |
| JP | 2000282162 A | * | 10/2000 |
| JP | 2001240930 A | | 9/2001 |

OTHER PUBLICATIONS

Zajac, et al., Microstructure control and extrudability of Al—Mg—Si alloys microalloyed with manganese, Article, Apr. 1994, pp. 323-333, vol. 10, Materials Science and Technology, Sweden.

Bishsel, et al. Metallographic investigation of the influence of small additions of manganese to AlMgSi0.5 alloys, Article, Jun. 1981, pp. 281-283, vol. 57, 7th International Conference on Light Metals, Leoben and Vienna.

Reiso, et al., The Effect of Composition and Homogenization Treatment on Extrudability of AlMgSi Alloys, Article, pp. 31-40, The Aluminum Association Third Extrusion Technology Seminar, vol. 1, 1984, Metallurgical Research and Development Centre.

Excerpt from the Registration Record of International Alloy Designations and Chemical Composition Limits for Wrought Aluminum and Wrought Aluminum Alloys, Article, Apr. 1991, 2 pp., The Aluminum Association.

Bryant, et al., Developments in Billet and Extrusion Metallurgy on the Operation of the Extrusion Process, article, Apr. 1998, pp. 6-34, Light Metal Age.

Couper, et al., Effect of Preheating Practices for Unhomogenized 6063 Alloy Billet on Billet Microstructure and Extruded Properties, the proceedings of Extrusion Technology 2000, Chicago, May 2000. pp. 51-59.

Excerpt from the Registration Record of International Alloy Designations and Chemical Composition Limits for Wrought Aluminum and Wrought Aluminum Alloys, Article, Oct. 2002, 2 pp., The Aluminum Association.

* cited by examiner

*Primary Examiner* — Christopher Kessler

(74) *Attorney, Agent, or Firm* — Banner & Witcoff, Ltd.

(57) ABSTRACT

An aluminum alloy includes, in weight percent, 0.70-0.85 Si, 0.14-0.25 Fe, 0.25-0.35 Cu, 0.05 max Mn, 0.75-0.90 Mg, 0.12-0.18 Cr, 0.05 max Zn, and 0.04 max Ti, the balance being aluminum and unavoidable impurities. The alloy may be suitable for extruding, and may be formed into an extruded alloy product.

22 Claims, 2 Drawing Sheets

ALUMINUM ALLOY COMBINING HIGH STRENGTH, ELONGATION AND EXTRUDABILITY

CROSS-REFERENCE TO RELATED APPLICATION

The present application is a divisional of U.S. patent application Ser. No. 13/905,986, filed May 30, 2013, which claims priority to and is a non-provisional filing of U.S. Provisional Application No. 61/653,531, filed May 31, 2012, which applications are incorporated by reference herein and made parts hereof.

FIELD OF THE INVENTION

The present invention relates generally to an aluminum alloy having high strength, elongation and extrudability, and in some specific aspects, to an aluminum alloy for use in extrusion and other applications, as well as methods for processing such alloys.

BACKGROUND

AA6061 is a widely accepted alloy for structural extrusions. There is extensive literature on AA6061 aluminum alloys, including U.S. Pat. Nos. 6,364,969 and 6,565,679. It is typically supplied to meet minimum properties associated with the AA6061 T6 temper:

- 240 MPa YS-260 MPa UTS and 8% elongation for section thickness<=6.30 mm
- 240 MPa YS-260 MPa UTS—10% elongation for section thickness>6.30 mm The alloy composition can be improved using relatively low levels of Mg and Si in order to optimise extrusion speed while still meeting these mechanical property targets. An example of this is U.S. Pat. No. 6,565,679. For thick section applications (i.e. >6.30 mm or 0.25 in.) such as anti-lock brake actuator units or heavily machined engineering parts, a higher yield strength is beneficial to improve machinability and also to allow some weight reduction. Uniformity of grain structure is also important to provide uniform machinability, and also because such parts are often anodized, and a mixed recrystallized and non-recrystallized or "fibrous" grain structure can lead to an undesirable visual appearance. For this reason, a predominantly fibrous grain structure with a thin surface recrystallized layer is preferred for such applications. Often the approach to increasing strength in 6XXX alloys is to increase additions of both magnesium and silicon to achieve the required strength levels, but this can be detrimental due to the increased flow stress and reduced melting point of the alloy.

The present invention is provided to address at least some of these problems and other problems, and to provide advantages and aspects not provided by prior alloys, processing methods, and articles. A full discussion of the features and advantages of the present invention is deferred to the following detailed description.

SUMMARY OF THE INVENTION

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the invention relate to an extrudable aluminum alloy composition comprising, in weight percent:

Si 0.70-0.85;
Fe 0.14-0.25;
Cu 0.25-0.35;
Mn 0.05 max;
Mg 0.75-0.90;
Cr 0.12-0.18;
Zn 0.05 max; and
Ti 0.04 max;

the balance being aluminum and unavoidable impurities.

According to one aspect, the unavoidable impurities may each be present at a maximum weight percent of 0.05, and the maximum total weight percent of the unavoidable impurities is 0.15. According to another aspect, the Mn content may be 0.03 max weight percent.

According to a further aspect, the composition may be provided in the form of a billet, ingot, or similar article.

According to yet another aspect, the alloy may be extruded, and the extruded alloy is processed so as to give a substantially non recrystallized structure containing deformed grains from the original billet. In one embodiment, less than about 20% of the cross section of the extruded alloy has undergone recrystallization. In one embodiment, less than about 10% of the cross section has undergone recrystallization. Such recrystallization percentages may be over at least a portion of the length of the extruded alloy, over a majority of the length of the extruded alloy, or over the entire length of the extruded alloy product.

According to a still further aspect, the alloy has a tensile yield strength of at least about 310 MPa and/or a tensile elongation of at least about 12%.

Additional aspects of the invention relate to a method for processing an alloy as described above. Such processing includes extruding the composition, press quenching and artificially aging the alloy. The term "press quenching" refers to quenching immediately after the metal exits the extrusion die. Prior to extruding, the alloy may also be homogenized. The extruded alloy is then quenched at a rate >10° C./sec, such as by using water mist, spray or quench bath. The quenching may be performed at a rate >50° C./sec in another embodiment. The alloy may be processed to achieve artificial aging, which may be carried out for about 2-24 hours at an aging temperature of, for example, 160-200° C. The method according to such aspects may produce an extruded aluminum alloy that may have properties as described above.

According to one aspect, the extrusion may be performed at an extrusion ratio of less than about 40/1 and/or with an extrusion strain of less than about 3.7. According to another aspect, the extruded product may have a minimum thickness of at least 6.30 mm or 0.25 in.

Further aspects of the invention relate to an aluminum extrusion or extruded aluminum alloy product formed of an alloy as described above. The extrusion may also be processed as in the method as described above and may have properties as described above.

According to one aspect, the extruded products may have a substantially non-recrystallized microstructure. For example, in one embodiment, less than about 20% of the extrusion cross section has undergone recrystallization. In another embodiment, less than about 10% of the extrusion cross section has undergone recrystallization. According to a further aspect, the extrusion may have a tensile yield strength of at least about 310 MPa in combination with a tensile elongation of at least about 12%

The alloy may be used in a wide range of extruded applications and other product forms such as sheet plate or forgings.

Other features and advantages of the invention will be apparent from the following description.

BRIEF DESCRIPTION OF THE DRAWINGS

To allow for a more full understanding of the present invention, it will now be described by way of example, with reference to the accompanying drawings in which.

DETAILED DESCRIPTION

Figure 1A:
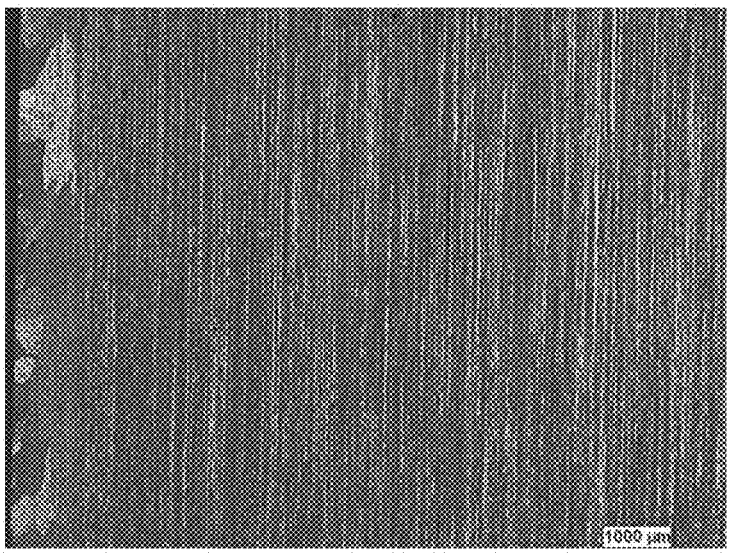
FIGS. 1*a* and 1*b* are micrographs illustrating the grain structure of one embodiment of an extruded alloy according to aspects described herein.

In general, the alloy composition of the present invention uses a combination of a low magnesium content and a high silicon content, whereas the conventional approach to increasing strength in AA6061 is to increase both Mg and Si. The resultant alloy may have a solution temperature lower than the high Mg-high Si alloys typically used for similar applications, allowing for more efficient use of the alloy additions. The resultant alloy may also have high mechanical strength and improved extrudability over alternate compositions capable of similar strength levels. The alloy also utilizes Cr addition, and the high silicon content and low homogenisation temperature combine to promote a fine Cr dispersoid distribution in the ingot, which increases Zener pinning and suppresses recrystallization and promotes a recovered fibrous grain structure. The latter may, in turn, provide superior ductility for an equivalent yield strength. Additionally, the alloy may achieve these strength and ductility increases with excellent efficiency of utilisation of the alloy additions for strengthening and little, if any, detriment to extrudability.

The alloy may include silicon in an amount of 0.70-0.85 wt. % or about 0.70-0.85 wt. % in one embodiment. As stated above, this level of silicon is increased with respect to the silicon levels typically used in commercial AA6061 alloys. Additionally, this silicon content may assist in increasing strength, lowering solution temperature, and promoting a fine Cr dispersoid distribution in the ingot.

The alloy may include iron in an amount of 0.14-0.25 wt. % or about 0.14-0.25 wt. % in one embodiment.

The alloy may include copper in an amount of 0.25-0.35 wt. % or about 0.25-0.35 wt. % in one embodiment.

The alloy may include manganese in an amount of 0.05 max wt. % Mn or about 0.05 max wt. % Mn in one embodiment. In another embodiment, the alloy may include manganese in an amount of 0.03 max wt. % or about 0.03 max wt. %.

The alloy may include magnesium in an amount of 0.75-0.90 wt. % or about 0.75-0.90 wt. % in one embodiment. As stated above, this amount of magnesium is similar to the amount of magnesium in AA6061.

The alloy may include chromium in an amount of 0.12-0.18 wt. % or about 0.12-0.18 wt. % in one embodiment. As stated above, this level of chromium is increased with respect to the chromium levels in AA6061. A fine Cr dispersoid distribution in the alloy can increase Zener pinning and suppress recrystallization, as well as promote a recovered fibrous grain structure.

The alloy may include zinc in an amount of 0.05 max wt. % or about 0.05 max wt. % in one embodiment.

The alloy may include titanium in an amount of 0.04 max wt. % or about 0.04 max wt. % in one embodiment.

The balance of the alloy includes aluminum and unavoidable impurities. The unavoidable impurities may each be present at a maximum weight percent of 0.05 or about 0.05, and the maximum total weight percent of the unavoidable impurities may be 0.15 or about 0.15, in one embodiment. Additionally, the alloy may include further alloying additions in another embodiment.

The alloy may be used in forming a variety of different articles, and may be initially produced as a billet. The term "billet" as used herein may refer to traditional billets, as well as ingots and other intermediate products that may be produced via a variety of techniques, including casting techniques such as continuous or semi-continuous casting and others. Further processing may be used to produce articles of manufacture using the alloy, such as extruded articles, which may be produced by extruding the billet to form the extruded article. It is understood that an extruded article may have a constant cross section in one embodiment, and may be further processed to change the shape or form of the article, such as by cutting, machining, connecting other components, or other techniques.

The alloy may have a substantially non-recrystallized structure containing deformed grains from the original billet. As described above, the formation of fine Cr dispersoids can assist in achieving this microstructure by suppressing recrystallization of the grain structure during the extrusion (or other hot deformation). In one embodiment, less than about 20% of the cross section of the entire extrusion has undergone recrystallization. In another embodiment, less than about 10% of the cross section of the entire extrusion has undergone recrystallization. It is understood that the "entire" extrusion or the "entire length" of the extrusion, as used herein, refers to the entire salable length of the extrusion. In a further embodiment, the above amounts of recrystallization may occur over a majority (>50%) of the length, or over at least a portion of the length of the extrusion. In yet another embodiment, the above amounts of recrystallization may occur as an average across the entire salable length of the extrusion.

In one embodiment, the alloy or an article produced from the alloy, has a tensile yield strength of at least about 310 MPa and a tensile elongation of at least about 12%.

The alloy may be processed using one or more of a variety of techniques, such as to form an article and/or achieve desired properties. As described above, such processing may include extruding the alloy or forming the alloy into an article using a different technique. The alloy may be used for thick gauge extrusions in one embodiment, which have minimum thicknesses greater than 6.30 mm or 0.25 in., although the alloy may be used in other applications as well. Additionally, an extrusion ratio of about 40/1 or less and/or an extrusion strain of less than about 3.7 may be used in one embodiment. In one embodiment, the alloy processing may include press quenching and/or artificial aging techniques.

The term "press quenching" refers to quenching immediately after the metal exits the extrusion die. Prior to extruding, the alloy may also be homogenized in one embodiment, for example, by heating to about 550-575° C. for about 2-8 hours or another effective homogenization cycle. In one embodiment, the extruded alloy may be quenched (e.g., by press quenching) after extrusion, such as by using water mist, spray, and/or quench bath. The cooling rate achieved by such quenching may be at least 10° C./sec in one embodiment, or may be at least 50° C./sec on another embodiment. It is noted that the quench rates reported herein were measured for cooling between 510° C. (i.e., close to the typical exit temperature) and 200° C. An in situ solution treatment may also be accomplished in connection with the quenching. Additionally, in one embodiment, the alloy may be processed to achieve artificial aging, such as by heating for 2-24 hours at an aging temperature of, for example, 160-200° C. Other processing techniques may be used in further embodiments.

Example 1

The following example illustrates beneficial properties that can be obtained with embodiments of the invention. Four alloy compositions, control (standard high speed AA6061) and alloys A, B, and C were DC cast as 101 mm diameter billets, homogenised and cooled at 350° C./h. A series of three extrusion tests were conducted using a 780-tonne extrusion press. In each case, the extrusion was water quenched and aged for 8 h/170° C. Tensile properties were measured on each extrusion and grain structures were assessed metallographically for the % of the cross section that was recrystallized. The alloy compositions and test results are summarised in Table 1.

The control alloy is typical of a dilute AA6061 alloy used for general applications, with a magnesium content close to the AA6061 specification minimum and silicon content close to the balanced level associated with $Mg_2Si$. The Cr content is <0.10 wt %, which is intended to give adequate toughness for structural applications without compromising quench sensitivity and extrudability. The experimental alloys A, B, and C all had increased Cr additions relative to AA6061, which, as described above, can help to promote a non-recrystallized grain structure. Alloy A has the Cr level is raised from 0.08 to 0.15 wt % relative to the base alloy AA6061. Alloy B is a typical AA6061 composition used commercially in order to try and achieve higher mechanical properties and has increased Mg and Si levels for this purpose. Alloy C has similar Mg content as the control alloy AA6061 but the silicon content is significantly higher and the Cr content is higher as well.

Billet temperature 480° C., ram speed 5-10 mm/s, extrusion ratio 70/1, profile 3×42 mm. The cooling rate during quenching is estimated at 300° C./sec between 510° C. and 200° C. Breakthrough pressure and tensile properties were measured. The breakthrough pressure values at 8 mm/s ram speed were compared, and the % increase in breakthrough pressure compared to the control alloy is presented in column ΔP % in Table 1.

Billet Temperature 520° C., ram speed 5-9 mm/s, extrusion ratio 70/1, profile 3×42 mm. The cooling rate during quenching is estimated at 300° C./sec between 510° C. and 200° C. The maximum ram speed attainable for each alloy without encountering hot tearing was assessed and the relative extrusion speed vs. the control is expressed as a percentage in column ΔV %.

Billet temperature 500° C., ram speed 8 mm/s, extrusion ratio 22/1, profile 50×8 mm. The cooling rate during quenching is estimated at 158° C./sec between 510° C. and 200° C. The breakthrough pressure was recorded and the % increase in breakthrough pressure vs. the control alloy is expressed as ΔP % in Table 1.

The yield strength (YS), elongation (% El) and amount of recrystallization (% RX) were measured for all alloys tested in all three trials. These results are also reported in Table 1.

In test 1, alloy C was the closest of the four alloys to meeting the property targets of 310 MPa YS and 12% elongation but did not quite meet these targets, although the property levels achieved were superior to the standard AA6061 control and alloys A and B. Surprisingly, the pressure increase for alloy C compared to the control alloy was lower than alloys A and B.

In test 2, all four alloys exhibited a strength increase caused at least partially by the increased solutionizing effect due to the higher preheat temperature. Alloy B was close to the property targets but alloy C gave the highest yield strength, well in excess of 310 MPa, and gave a higher tearing speed than alloy B.

In test 3, alloy B was again close to the property targets, and alloy C again had the highest yield strength and exceeded the target strength and elongation.

In both trials 1 and 2, the extrusions were predominantly recrystallized. In trial 3, the lower extrusion ratio produced a substantially non-recrystallized or fibrous grain structure with a shallow recrystallized layer at the surface (expressed as % RX in Table 1—e.g., 100% indicates the full cross section was recrystallized, 20% indicates 20% of the cross section was recrystallized and 80% was non recrystallized. This resulted in a significant improvement in elongation for all four alloys and all four met the 12% elongation target. At the same time, the billet temperature was intermediate between tests 1 and 2, which in turn gave intermediate

TABLE 1

| Extrusion Test Results | | | | | | | | | | | | | | | | | | |
|---|---|---|---|---|---|---|---|---|---|---|---|---|---|---|---|---|---|---|
| | | | | | | | R = 70/1, TB 480 C. | | | | R = 70/1, TB 520 C. | | | | R = 22/1, TB 500 C. | | | |
| Alloy | Mg | Si | Cu | Mn | Fe | Cr | ΔP % | YS | % El | % RX | ΔV % | YS | % El | % RX | ΔP % | YS | % El | % RX |
| Control | 0.80 | 0.56 | 0.20 | 0.01 | 0.17 | 0.08 | . . . | 264 | 11.4 | 100 | 100 | 274 | 15.4 | 100 | . . . | 255 | 19.8 | 80 |
| A | 0.81 | 0.55 | 0.29 | 0.02 | 0.17 | 0.15 | 8.8 | 268 | 10.4 | 90 | 80 | 289 | 12.1 | 95 | 8.2 | 284 | 18.5 | 27 |
| B | 0.98 | 0.69 | 0.29 | <.01 | 0.17 | 0.15 | 9.6 | 276 | 10.3 | 90 | 50 | 308 | 11.3 | 95 | 7.5 | 303 | 16.5 | 22 |
| C | 0.82 | 0.78 | 0.30 | 0.01 | 0.17 | 0.15 | 5.2 | 302 | 10.9 | 80 | 60 | 339 | 10 | 80 | 4.4 | 327 | 16.2 | 20 |

Three trials were conducted, using different processing parameters. A summary of the individual trial conditions follows:

solutionizing and yield strength values. Under these conditions, alloy C was the only composition to meet the yield strength and elongation targets. Again, the increase in extrusion breakthrough pressure for alloy C was lower than for alloys A and B, which was unexpected.

Overall, alloy C gave the best combination of yield strength and ductility in all conditions and met the target property values of 310 MPa YS—12% El when the extrusion conditions were controlled to give a substantially fibrous grain structure. At the same time, surprisingly, alloy C required lower breakthrough pressure than alloys A and B, which can permit the alloy to be extruded faster at lower cost. These benefits were obtained with Alloy C for both thick gauge (more than 6.30 mm or 0.25 in. minimum thickness) and thin gauge (6.30 mm or 0.25 in. or less minimum thickness) alloys. Alloy C also exhibited superior hot tearing speed to alloy B, which represents a typical high strength AA6061 used in North America today.

Example 2

Alloy composition D (0.84 wt. % Mg, 0.77 wt. % Si, 0.29 wt. % Cu, 0.18 wt. % Fe, 0.14 wt. % Cr) was DC cast and homogenized as described above with respect to Example 1. The billets were extruded into a 3×42 mm profile at a billet temperature of 500° C. using a ram speed of 5 mm/s. The quench rate at the press exit was varied on successive billets by applying a slow air quench, a fast air quench, and a standing wave water quench to give quench rates of 2° C./sec, 8° C./sec and 300° C./sec. The material was aged for 8 hrs/170° C. Table 2 shows tensile properties and % recrystallization values of these samples.

TABLE 2

Quench Test Results (YS and UTS in MPa)

| Quench | Quench Rate ° C./sec | YS | UTS | % El | % RX |
|---|---|---|---|---|---|
| slow air | 2 | 252 | 300 | 10 | 30 |
| fast air | 8 | 287 | 327 | 12 | 35 |
| water | 300 | 306 | 337 | 13 | 34 |

As seen in Table 2, the cross section was at least 30% recrystallized in all samples due to the narrow section thickness, and the 310 MPa target yield strength was not achieved. However, it is clear from the data in Table 2 that fast quenching as achieved by water quenching gives superior strength and ductility compared to air quenching. Thus, a minimum quench rate of at least 10° C./sec is desirable. While this test was conducted on a thin gauge alloy, the result would apply to thick gauge alloys (>6.30 mm) as well.

Example 3

Alloy composition D (0.84 wt. % Mg, 0.77 wt. % Si, 0.29 wt. % Cu, 0.18 wt. % Fe, 0.14 wt. % Cr) was cast and homogenized as described in Example 2 and extruded into a 50×8 mm profile (extrusion ratio of 22/1) using billet temperatures ranging from 475-520° C. and ram speeds from 4-10 mm/sec in order to assess the effect of process conditions on mechanical properties. The extrusion was water quenched at the press and subsequently aged for 8 hrs at 170° C. The cooling rate during quenching is estimated at 158° C./sec between 510° C. and 200° C. Tensile testing was conducted using the full section thickness of 8 mm and the grain structure was assessed at front and back positions along the extruded length. The results of this testing are summarized in Table 3 below.

TABLE 3

Extrusion Test Results

| | | | MPa | | | | |
|---|---|---|---|---|---|---|---|
| Billet Temp ° C. | ram speed mm/s | exit temp ° C. | YS | UTS | % El | % RX front | % RX back |
| 520 | 4 | 515 | 345.7 | 372.6 | 15.3 | 9.6 | 9.6 |
| 520 | 6 | 516 | 345.3 | 375.4 | 14.3 | 7.7 | 13.4 |
| 500 | 6 | 515 | 344.7 | 371 | 15.1 | 7.7 | 14.4 |
| 500 | 8 | 528 | 346.5 | 375.5 | 16 | 7.7 | 13.4 |
| 475 | 8 | 516 | 340.6 | 369 | 15.8 | 9.6 | 13.4 |
| 475 | 10 | 519 | 342.2 | 373.6 | 15.5 | 9.6 | 15.3 |

Figure 1B:
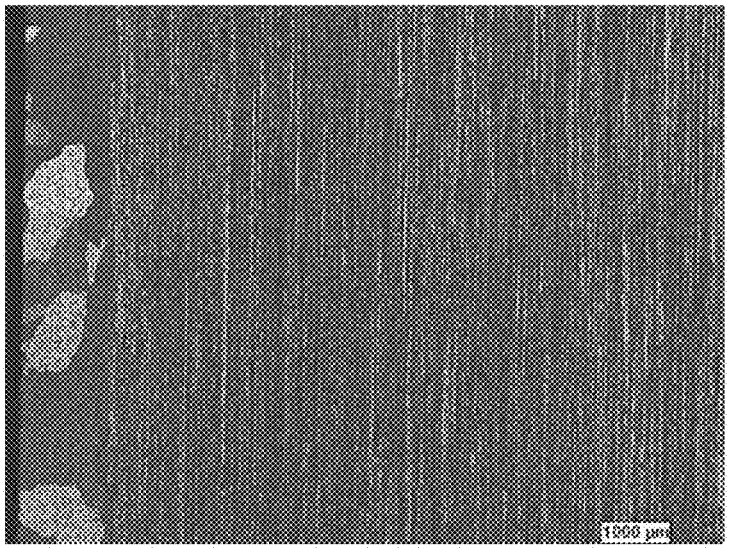

All the ram speed/billet temperature combinations resulted in an exit temperature >510° C. which is normally considered the target for medium strength 6XXX alloys. Typical longitudinal grain structures exhibited by the tested alloy are shown in FIGS. 1*a* and 1*b*, which illustrate the microstructure of a sample extruded at 520° C. with a ram speed of 6 mm/sec at the front (FIG. 1*a*) and back (FIG. 1*b*) of the extruded sample. As seen in FIGS. 1*a* and 1*b*, the section core was observed to be fibrous (non-recrystallized), and there was a thin surface recrystallized layer. The depth of this layer is expressed as a % of the section thickness in Table 3 (% RX). The yield strength and elongation values achieved over a wide range of press conditions were well in excess of the 310 MPa and 12% targets. The depth of recrystallization increased from front to back of the extruded length, which is normal for direct extrusion. The maximum recrystallization recorded was 15.3% at the back of the extrusion produced at the highest ram speed.

Example 4

Alloy D (0.84 wt. % Mg, 0.77 wt. % Si, 0.29 wt. % Cu, 0.18 wt. % Fe, 0.14 wt. % Cr) was cast and homogenized as described in Example 3 and then extruded into a 66×18 mm profile with an extrusion ratio of 7/1. Billet temperatures ranged from 505 to 523° C. and the ram speed was varied from 10-30 mm/s which resulted in exit temperatures in excess of 510° C. The extrusion was water quenched at the press and subsequently aged for 8 hrs at 170° C. The cooling rate during quenching is estimated at 128° C./sec between 510° C. and 200° C. The test results are summarized in Table 4.

TABLE 4

| Extrusion Test Results | | | | | | | |
|---|---|---|---|---|---|---|---|
| Billet Temp ° C. | ram speed mm/s | exit temp ° C. | YS | UTS | % El | % RX front | % RX back |
| 521 | 10 | — | 369.3 | 401 | 16.9 | 0.9 | 2.1 |
| 523 | 20 | 537 | 366.2 | 396.5 | 13.4 | 2.6 | 3.4 |
| 505 | 30 | 535 | 368.9 | 394.8 | 15.7 | 2.1 | 4.3 |
| 521 | 25 | 542 | 368.5 | 396.8 | 12.5 | 1.7 | 4.3 |

Figure 2A:
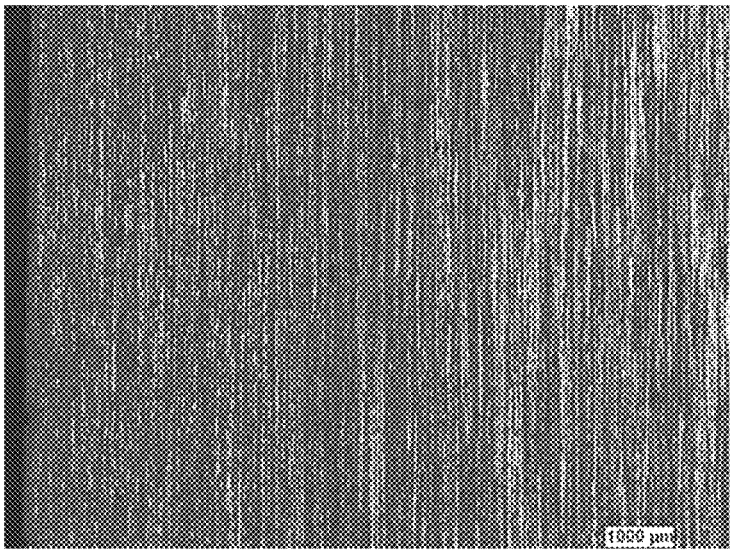
FIGS. 2*a* and 2*b* are micrographs illustrating the grain structure of one embodiment of an extruded alloy according to aspects described herein.
Figure 2B:
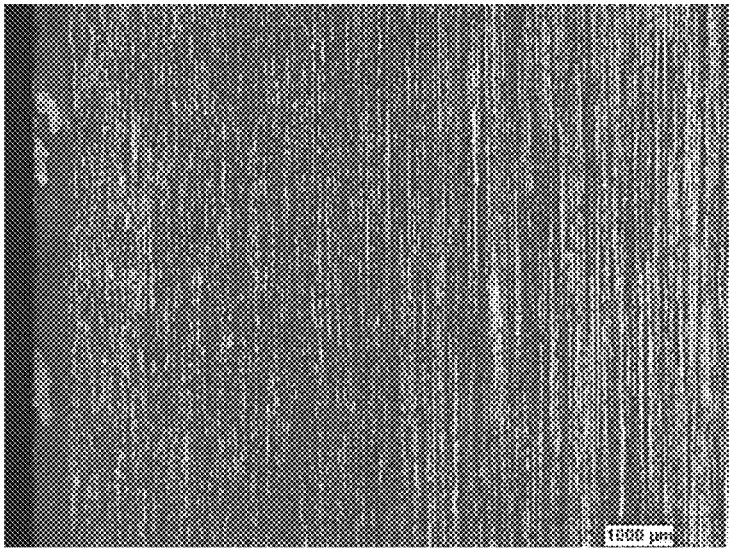

The section was machined to 12 mm thickness around the centerline for tensile testing. On this profile, a yield strength in excess of 360 MPa was achieved with elongation values >12%. Typical longitudinal grain structures exhibited by the tested alloy are shown in FIGS. 2*a* and 2*b*, which illustrate the microstructure of a sample extruded at 521° C. with a ram speed of 10 mm/sec at the front (FIG. 2*a*) and back (FIG. 2*b*) of the extruded sample. Again the structure was predominantly fibrous with only a thin recrystallized surface layer.

The results from Examples 2-4 indicate that with a press water quench combined with thick section extrusions, e.g., 8-18 mm, Alloy D can achieve an excellent combination of strength and ductility. The water quench prevents waste of the Mg, Si and Cu added to the alloy by inhibiting precipitation of coarse non-hardening solute phases during quenching. Compared to the thinner 3 mm profile, the lower strain during extrusion associated with the 8 mm and 18 mm profiles maintained the % recrystallization <20% and allowed a good yield strength and ductility balance to be achieved. Accordingly, the various embodiments of the alloy described above can produce excellent yield strength and ductility balance when used for thick gauge extrusions, such as having an extrusion thickness of 6.30 mm or 0.25 in.

Further, as described above, the lower strain during extrusion associated with the thicker gauge profiles assisted in maintaining the recrystallization below 20%. The strain in extrusion is proportional to $\log_e$ (extrusion ratio) where the extrusion ratio is the cross sectional area of the press container/cross section of the profile. The extrusion ratios and corresponding strain values for the three profiles tested in Examples 1-4 were as follows:

| Billet Size | Extrusion Ratio | Extrusion Strain |
|---|---|---|
| 42 × 3 mm | 70/1 | 4.2 |
| 50 × 8 mm | 22/1 | 3.1 |
| 66 × 18 mm | 7/1 | 1.9 |

Thus, the various embodiments of the alloy described above can produce excellent yield strength and ductility balance when extruded using an extrusion ratio of less than about 40/1 and/or an average extrusion strain of less than about 3.7. It is understood that while the extrusion ratio of less than about 40/1 and the average extrusion strain of less than about 3.7 are shown in the above example for producing thick gauge extrusions, this same extrusion rate and extrusion strain may be used by those skilled in the art in producing smaller gauge extrusions, and similar benefits may be expected.

The embodiments described herein can provide advantages over existing alloys, extrusions, and processes, including advantages over typical AA6061 alloys. For example, alloys described herein may have a solution temperature lower than the high Mg-high Si alloys typically used for similar applications, allowing for more efficient use of the alloy additions. Alloys described herein may also have high mechanical strength and improved extrudability over alternate compositions capable of similar strength levels. Further, alloys described herein utilize Cr additions, and the high silicon content and low homogenisation temperature combine to promote a fine Cr dispersoid distribution in the ingot, which increases Zener pinning and suppresses recrystallization and promotes a recovered fibrous grain structure. This may, in turn, provide superior ductility for an equivalent yield strength. Still further benefits and advantages are recognizable to those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims. All compositions herein are expressed in weight percent, unless otherwise noted. It is understood that compositions and other numerical values modified by the term "about" herein may include variations beyond the exact numerical values listed.

What is claimed is:

1. An extruded aluminum alloy product formed of an aluminum alloy comprising, in weight percent, 0.70-0.85 Si, 0.14-0.25 Fe, 0.25-0.35 Cu, 0.05 max Mn, 0.75-0.90 Mg, 0.12-0.18 Cr, 0.05 max Zn, and 0.04 max Ti, the balance being aluminum and unavoidable impurities, wherein less than about 20% of a cross section of the extruded aluminum alloy product has undergone recrystallization over at least a portion of a length of the extruded aluminum alloy product.

2. The extruded aluminum alloy product of claim 1, wherein the unavoidable impurities may each be present at a maximum weight percent of 0.05, and the maximum total weight percent of the unavoidable impurities is 0.15.

3. The extruded aluminum alloy product of claim 1, wherein the Mn content is 0.03 max weight percent.

4. The extruded aluminum alloy product of claim 1, wherein less than about 10% of the cross section has undergone recrystallization over the at least a portion of the length of the extruded aluminum alloy product.

5. The extruded aluminum alloy product of claim 1, wherein less than about 20% of a cross section of the extruded aluminum alloy product has undergone recrystallization over an entire length of the extruded aluminum alloy product.

6. The extruded aluminum alloy product of claim 5, wherein less than about 10% of the cross section has undergone recrystallization over the entire length of the extruded aluminum alloy product.

7. The extruded aluminum alloy product of claim 1, wherein the extruded aluminum alloy product has a tensile yield strength of at least 310 MPa.

8. The extruded aluminum alloy product of claim 7, wherein the extruded aluminum alloy product has a tensile elongation of at least 12%.

9. The extruded aluminum alloy product of claim 1, wherein the extruded aluminum alloy product has a fine Cr dispersoid distribution.

10. An extruded aluminum alloy product formed of an aluminum alloy comprising, in weight percent, 0.70-0.85 Si, 0.14-0.25 Fe, 0.25-0.35 Cu, 0.05 max Mn, 0.75-0.90 Mg, 0.12-0.18 Cr, 0.05 max Zn, and 0.04 max Ti, the balance being aluminum and unavoidable impurities, wherein the unavoidable impurities may each be present at a maximum weight percent of 0.05, and the maximum total weight percent of the unavoidable impurities is 0.15, wherein the extruded aluminum alloy product is homogenized prior to extrusion, and wherein less than about 20% of a cross section of the extruded alloy has undergone recrystallization over at least a portion of a length of the extruded aluminum alloy product.

11. The extruded aluminum alloy product of claim 10, wherein less than about 20% of the cross section has undergone recrystallization over at least a majority of the length of the extruded aluminum alloy product.

12. The extruded aluminum alloy product of claim 10, wherein less than about 10% of the cross section has undergone recrystallization over the at least a portion of the length of the extruded aluminum alloy product.

13. The extruded aluminum alloy product of claim 10, wherein less than about 20% of a cross section of the extruded aluminum alloy product has undergone recrystallization over an entire length of the extruded aluminum alloy product.

14. The extruded aluminum alloy product of claim 13, wherein less than about 10% of the cross section has undergone recrystallization over the entire length of the extruded aluminum alloy product.

15. The extruded aluminum alloy product of claim 10, wherein the extruded aluminum alloy product has a tensile yield strength of at least 310 MPa and a tensile elongation of at least 12%.

16. The extruded aluminum alloy product of claim 10, wherein the extruded aluminum alloy product has a fine Cr dispersoid distribution.

17. An extruded aluminum alloy product formed of an aluminum alloy comprising, in weight percent, 0.70-0.85 Si, 0.14-0.25 Fe, 0.25-0.35 Cu, 0.05 max Mn, 0.75-0.90 Mg, 0.12-0.18 Cr, 0.05 max Zn, and 0.04 max Ti, the balance being aluminum and unavoidable impurities, wherein the unavoidable impurities may each be present at a maximum weight percent of 0.05, and the maximum total weight percent of the unavoidable impurities is 0.15, wherein the extruded aluminum alloy product is homogenized prior to extrusion, and wherein less than 20% of a cross section of the extruded aluminum alloy product has undergone recrystallization over at least a portion of a length of the extruded aluminum alloy product, and wherein the extruded aluminum alloy product has a tensile yield strength of at least 310 MPa and a tensile elongation of at least 12%.

18. The extruded aluminum alloy product of claim 17, wherein less than 10% of the cross section has undergone recrystallization over the at least a portion of the length of the extruded aluminum alloy product.

19. The extruded aluminum alloy product of claim 17, wherein less than 20% of a cross section of the extruded aluminum alloy product has undergone recrystallization over the entire length of the extruded aluminum alloy product.

20. The extruded aluminum alloy product of claim 19, wherein less than 10% of the cross section has undergone recrystallization over the entire length of the extruded aluminum alloy product.

21. The extruded aluminum alloy product of claim 17, wherein the extruded aluminum alloy product has a minimum cross-sectional thickness greater than 6.30 mm.

22. The extruded aluminum alloy product of claim 17, wherein the extruded aluminum alloy product has a fine Cr dispersoid distribution.

* * * * *